US009271575B1

(12) United States Patent
Leff

(10) Patent No.: US 9,271,575 B1
(45) Date of Patent: Mar. 1, 2016

(54) STADIUM SEAT ASSEMBLY

(71) Applicant: Ben Leff, Cedar Park, TX (US)

(72) Inventor: Ben Leff, Cedar Park, TX (US)

( * ) Notice: Subject to any disclaimer, the term of this patent is extended or adjusted under 35 U.S.C. 154(b) by 0 days.

(21) Appl. No.: 14/464,483

(22) Filed: Aug. 20, 2014

(51) Int. Cl.

| | |
|---|---|
| ***A47C 31/00*** | (2006.01) |
| ***A47C 1/16*** | (2006.01) |
| ***A47C 4/30*** | (2006.01) |
| ***A47C 7/62*** | (2006.01) |
| *A47C 1/10* | (2006.01) |
| *A47C 1/14* | (2006.01) |
| *A47C 7/42* | (2006.01) |
| *A47C 7/02* | (2006.01) |

(52) U.S. Cl.
CPC ... *A47C 1/16* (2013.01); *A47C 4/30* (2013.01); *A47C 7/62* (2013.01); *A47C 1/10* (2013.01); *A47C 1/146* (2013.01); *A47C 7/021* (2013.01); *A47C 7/425* (2013.01)

(58) Field of Classification Search
CPC ..... A47C 7/021; A47C 7/425; A47C 1/146; A47C 5/10
USPC ..... 297/180.11, 229, 352, 228.13, 252, 297/230.1, 230.11, 17
See application file for complete search history.

(56) References Cited

U.S. PATENT DOCUMENTS

| | | | | |
|---|---|---|---|---|
| 2,108,531 | A * | 2/1938 | Flanders | 297/380 |
| 3,066,980 | A | 12/1962 | Clute | |
| 4,799,731 | A * | 1/1989 | Brown | 297/188.12 |
| 4,826,242 | A * | 5/1989 | Trethewey | 297/184.14 |
| 4,854,637 | A | 8/1989 | McCree | |
| 4,998,311 | A * | 3/1991 | Ernst | 5/654 |
| 5,016,792 | A * | 5/1991 | Jay | 224/155 |
| 5,454,623 | A * | 10/1995 | Parks | 297/230.1 |
| 5,516,193 | A | 5/1996 | Simpson | |
| 5,588,570 | A * | 12/1996 | Zirbel | A45F 4/02 224/155 |
| 5,785,427 | A * | 7/1998 | Godshaw | 383/4 |
| 6,079,599 | A | 6/2000 | Nordstrom et al. | |
| D438,719 | S | 3/2001 | Ford, Jr. | |
| 6,244,481 | B1 | 6/2001 | Brougher | |
| 6,502,902 | B1 * | 1/2003 | Romero | A47C 5/10 297/352 |
| 6,848,746 | B2 * | 2/2005 | Gentry | A47C 7/748 297/180.11 |
| 6,863,350 | B1 * | 3/2005 | McCulley et al. | 297/465 |
| RE39,022 | E * | 3/2006 | Welsh | A45F 4/02 224/153 |
| 7,086,694 | B1 * | 8/2006 | Huang | A47D 1/02 297/35 |
| D571,115 | S * | 6/2008 | Cohen | D6/368 |
| 7,438,356 | B2 * | 10/2008 | Howman | A47C 7/021 297/17 |
| D634,951 | S | 3/2011 | Dreiling | |
| 8,075,059 | B2 * | 12/2011 | Kim | A47C 1/146 297/16.1 |
| 8,123,090 | B2 | 2/2012 | Missick | |
| 2006/0202533 | A1 * | 9/2006 | Goodman | 297/352 |
| 2007/0152479 | A1 * | 7/2007 | Howman et al. | 297/180.11 |
| 2009/0293255 | A1 | 12/2009 | Jones | |
| 2012/0211536 | A1 | 8/2012 | Lowry | |

FOREIGN PATENT DOCUMENTS

| | | | |
|---|---|---|---|
| KR | 200466710 | Y1 | 4/2013 |

* cited by examiner

*Primary Examiner* — Chi Q Nguyen

(57) ABSTRACT

A stadium seat assembly facilitates the carrying of a stadium seat to and from a sporting event. The assembly includes a seat. A shoulder strap is provided having a first end and a second end each coupled to the seat. The shoulder strap is configured for extending around a shoulder of a user for supporting the seat from the user's shoulders.

9 Claims, 3 Drawing Sheets

STADIUM SEAT ASSEMBLY

BACKGROUND OF THE DISCLOSURE

Field of the Disclosure

The disclosure relates to seat devices and more particularly pertains to a new seat device for facilitating the carrying of a stadium seat to and from a sporting event.

SUMMARY OF THE DISCLOSURE

An embodiment of the disclosure meets the needs presented above by generally comprising a seat. A shoulder strap is provided having a first end and a second end each coupled to the seat. The shoulder strap is configured for extending around a shoulder of a user for supporting the seat from the user's shoulders.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
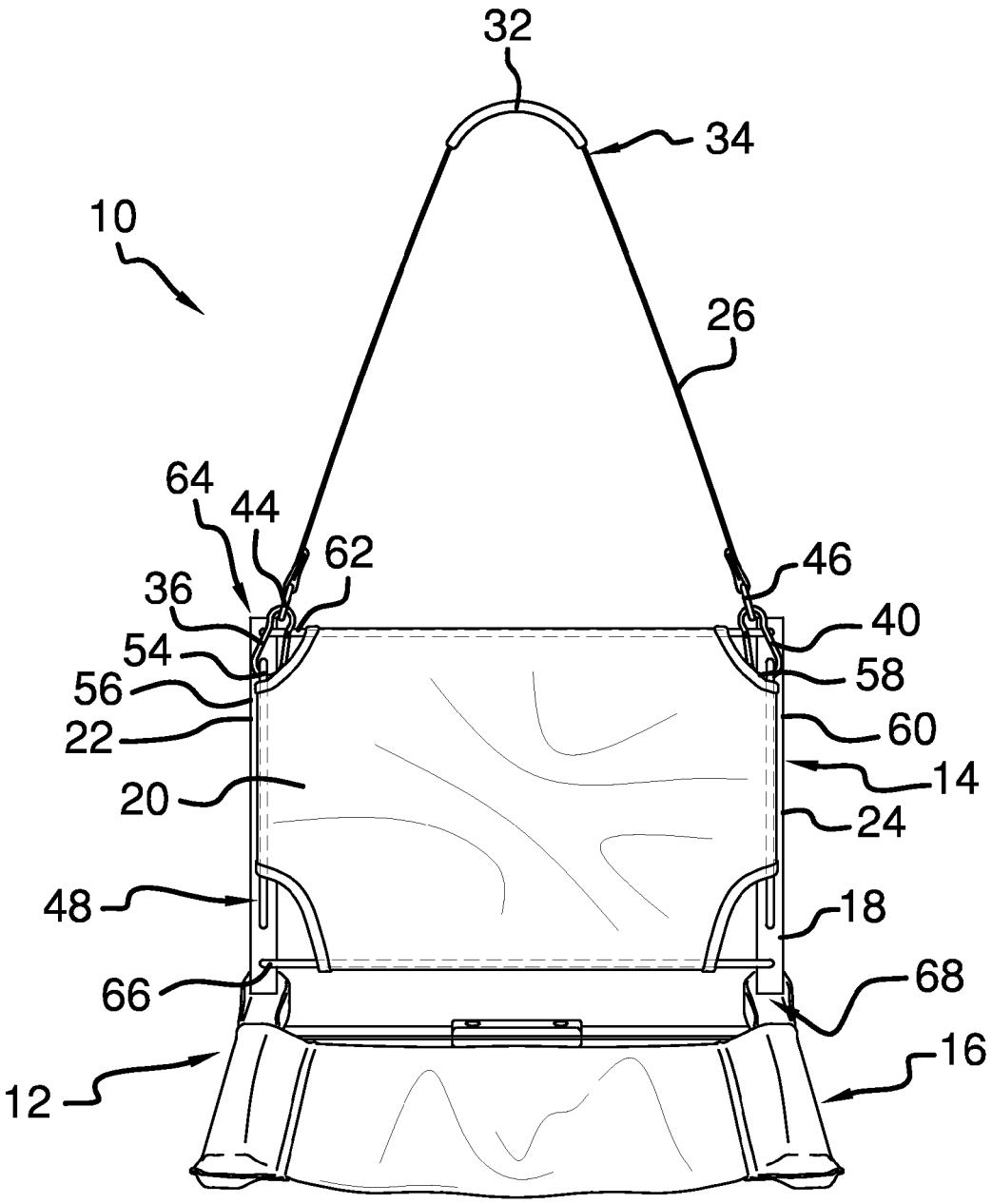
FIG. 1 is a front view of a stadium seat assembly according to an embodiment of the disclosure.
Figure 2:
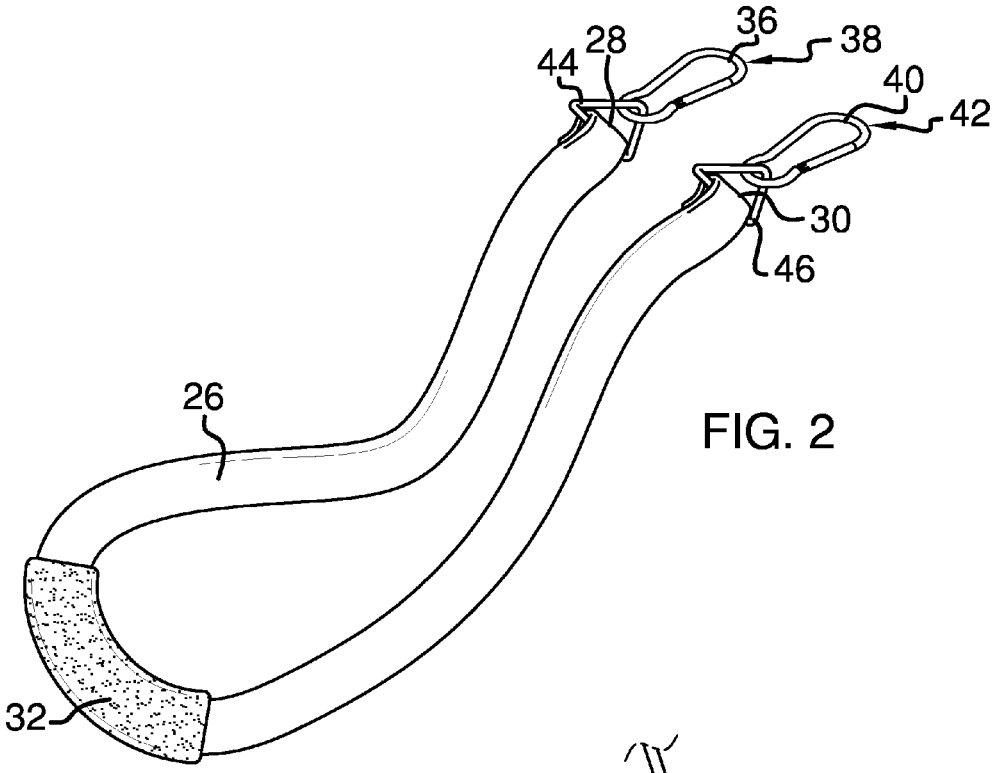
FIG. 2 is a perspective view of a strap of an embodiment of the disclosure.
Figure 3:
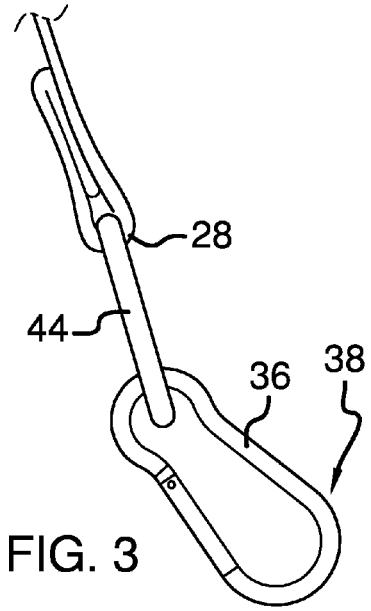
FIG. 3 is a detailed view of a strap of an embodiment of the disclosure.
Figure 4:
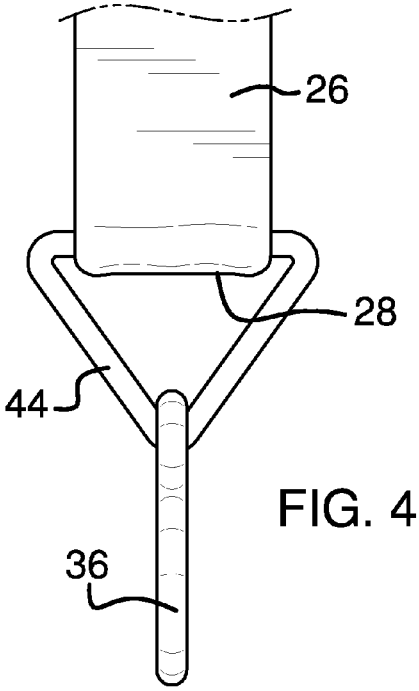
FIG. 4 is a detailed view of a strap of an embodiment of the disclosure.
Figure 5:
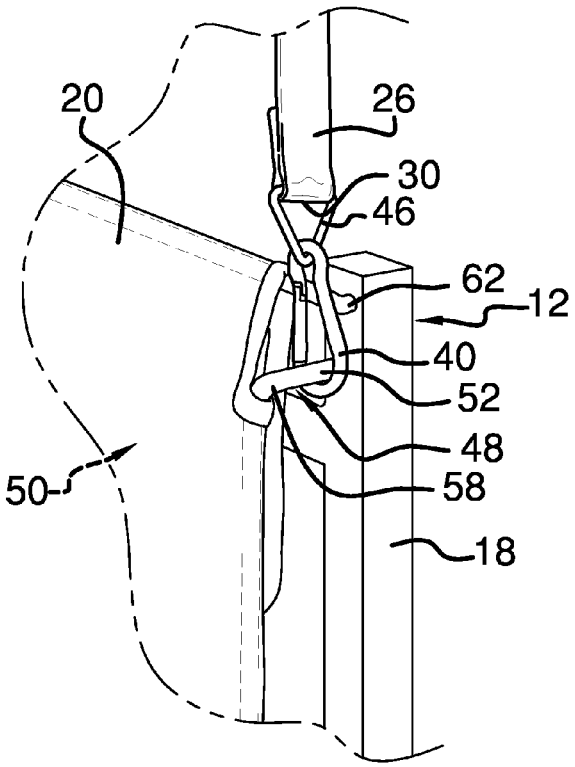
FIG. 5 is a front perspective view of an embodiment of the disclosure.

With reference now to the drawings, and in particular to FIGS. 1 through 5 thereof, a new seat device embodying the principles and concepts of an embodiment of the disclosure and generally designated by the reference numeral 10 will be described.

As best illustrated in FIGS. 1 through 5, the stadium seat assembly 10 generally comprises a seat 12, which may be of generally conventional design for use on a bleacher bench. The seat 12 includes a seat bottom 14 and a seat back 16 that may be hingedly coupled together. The seat bottom 14 includes a frame 18 and a panel 20. The panel 20 is attached to and extends between opposite sides 22, 24 of the frame 18.

A shoulder strap 26 is provided having a first end 28 and a second end 30 each coupled to the seat 12. The shoulder strap 26 is configured for extending around a shoulder of a user for supporting the seat 12 from the user's shoulders. The shoulder strap 26 may have a fixed length or may be adjustable. A distance between the first end 28 and second 30 end of the shoulder strap 26 may be between approximately 3.5 cm and 13.0 cm. Padding 32 is coupled to the shoulder strap 26 on a medial section 34 of the shoulder strap 26 positioned between the first end 28 and the second end 30 wherein the padding 32 is configured to cushion the shoulder of the user when the user extends the shoulder strap 26 around the user's shoulder.

A first clip 36 is engageable with and removably couples together the seat 12 and the first end 28 of the shoulder strap 26. The first clip 36 may be a carabiner clip 38. A second clip 40 is engageable with and removably couples together the seat 12 and the second end 30 of the shoulder strap 26. The second clip 40 may also be a carabiner clip 42. A first strap ring 44 is removably coupled to the first end 28 of the shoulder strap 26 and the first clip 36 whereby the first end 28 of the shoulder strap 26 is coupled to the first clip 36. A second strap ring 46 is removably coupled to the second end 30 of the shoulder strap 26 and the second clip 40 whereby the second end 30 of the shoulder strap 26 is coupled to the second clip 40. The first 44 and second 46 strap rings are constructed from a rigid material, such as plastic, metal or the like and may be attached to the shoulder strap 26 by sewing, grommets or other conventional fastening means.

A mount 48 couples the panel 20 to the frame 18. The mount 48 extends between the opposite sides 22, 24 of the frame 18 through an interior space 50 of the panel 20. Each of the first clip 36 and the second clip 40 is removably coupled to the mount 48 whereby the shoulder strap 26 is coupled to the seat 12. The mount 48 may comprise an elasticized cord 52 or a rigid support, such as a rod or the like. The mount 48 may have a first side section 54 attached to a first side 56 of the frame 18, a second side section 58 attached to a second side 60 of the frame 18, a front section 62 attached to the frame 18 proximate a front end 64 of the frame 18 and a rear section 66 attached to the frame 18 proximate a rear end 68 of the frame 18. The first side section 54, the second side section 58, the front section 62 and the rear section 66 of the mount 48 may be a single mount 48 each connected to each other or may comprise a plurality of separate mounts 48. Each of the first 54 and second 58 side sections extends longitudinally between the front end 64 and the rear end 68 of the frame 18. The first clip 36 may be removably coupled to the first side section 54 of the mount 48, while the second clip 40 may be removably coupled to the second side section 58 of the mount 48. Alternatively, both the first 36 and second 40 clips may be removably coupled to the front section 62 of the mount 48.

In use, the first clip 36 is attached to the first strap ring 44 and the first strap ring 44 is attached to the mount 48. Similarly, the second clip 40 is attached to the second strap ring 46 and the second strap ring 46 is attached to the mount 48. The shoulder strap 26 is extended around a shoulder of the user to carry the seat 12 on the user's shoulder. Upon arriving at a spectator event, the user positions the seat 12 on the bleacher bench in a conventional manner and uses the seat 12 for enhancing comfort while the user is sitting on the bleacher bench. Either the first end 28 or the second end 30 of the shoulder strap 30 can be unhooked from the mount 48 and wrapped around the bleacher bench and then reattached to the mount 48 to increase stability of the seat 12 on the bleacher bench.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A stadium seat assembly comprising:

a seat;

a shoulder strap having a first end and a second end each coupled to said seat, said shoulder strap being configured for extending around a shoulder of a user for supporting said seat from the user's shoulders;

a first clip removably coupling together said seat and said first end of said shoulder strap; and a second clip removably coupling together said seat and said second end of said shoulder strap;

said seat including a seat bottom having a frame and a panel, said panel being attached to and extending between opposite sides of said frame;

a mount coupling said panel to said frame, said mount extending between said opposite sides of said frame through an interior space of said panel; and each of said first clip and said second clip being removably coupled to said mount whereby said shoulder strap is coupled to said seat.

2. The assembly of claim 1, further comprising:

a first strap ring being removably coupled to said first end of said shoulder strap and said first clip whereby said first end of said shoulder strap is coupled to said first clip; and a second strap ring being removably coupled to said second end of said shoulder strap and said second clip whereby said second end of said shoulder strap is coupled to said second clip.

3. The assembly of claim 1, further comprising padding coupled to said shoulder strap on a medial section of said shoulder strap positioned between said first end and said second end wherein said padding is configured to cushion the shoulder of the user when the user extends said shoulder strap around the user's shoulder.

4. The assembly of claim 1, further comprising each of said first and second clips being carabiner clips.

5. The assembly of claim 1, further comprising said mount being an elasticized cord.

6. The assembly of claim 1, further comprising:

said mount having a first side section attached to a first side of said frame and a second side section attached to a second side of said frame, each of said first and second side sections extending longitudinally between a top end and a bottom end of said frame;

said first clip being removably coupled to said first side section of said mount; and said second clip being removably coupled to said second side section of said mount.

7. The assembly of claim 1, further comprising said seat including a seat bottom and a seat back hingedly coupled together.

8. The assembly of claim 1, further comprising:

said mount having a top section attached to said frame proximate a top end of said frame and a bottom section attached to said frame proximate a bottom end of said frame;

said first clip being removably couplable to said top section of said mount; and said second clip being removably couplable to said bottom section of said mount.

9. A stadium seat assembly comprising:

a seat including a seat bottom and a seat back hingedly coupled together, said seat bottom having a frame and a panel, said panel being attached to and extending between opposite sides of said frame;

a shoulder strap having a first end and a second end each coupled to said seat, said shoulder strap being configured for extending around a shoulder of a user for supporting said seat from the user's shoulders;

padding coupled to said shoulder strap on a medial section of said shoulder strap positioned between said first end and said second end wherein said padding is configured to cushion the shoulder of the user when the user extends said shoulder strap around the user's shoulder;

a first clip removably coupling together said seat and said first end of said shoulder strap, said first clip being a carabiner clip;

a second clip removably coupling together said seat and said second end of said shoulder strap, said second clip being a carabiner clip;

a first strap ring being removably coupled to said first end of said shoulder strap and said first clip whereby said first end of said shoulder strap is coupled to said first clip;

a second strap ring being removably coupled to said second end of said shoulder strap and said second clip whereby said second end of said shoulder strap is coupled to said second clip; and a mount coupling said panel to said frame, said mount extending between said opposite sides of said frame through an interior space of said panel, each of said first clip and said second clip being removably coupled to said mount whereby said shoulder strap is coupled to said seat, said mount being an elasticized cord, said mount having a first side section attached to a first side of said frame, a second side section attached to a second side of said frame, a front section attached to said frame proximate a front end of said frame and a rear section attached to said frame proximate a rear end of said frame, each of said first and second side sections extending longitudinally between said front end and said rear end of said frame, said first clip being removably coupled to said first side section of said mount, said second clip being removably coupled to said second side section of said mount.

* * * * *